United States Patent [19]

Stephanoff, deceased et al.

[11] Patent Number: 4,582,264

[45] Date of Patent: Apr. 15, 1986

[54] JET-TYPE GRINDING SYSTEMS FOR LARGE PARTICLES

[76] Inventors: Nicholas N. Stephanoff, deceased, late of Haverford, Pa.; by Raymond S. Page, III, executor, 1100 One Franklin Plz., Philadelphia, Pa. 19102

[21] Appl. No.: 586,341

[22] Filed: Mar. 5, 1984

[51] Int. Cl.[4] ..... B02G 23/30

[52] U.S. Cl. ..... 241/48; 241/57; 241/79.1; 241/80; 241/97; 241/275

[58] Field of Search ..... 241/48, 52, 57, 76, 241/79, 79.1, 80, 82, 97, 275, 5

[56] References Cited

U.S. PATENT DOCUMENTS

| | | | |
|---|---|---|---|
| 3,595,486 | 7/1971 | Stepanoff | 241/5 X |
| 3,941,684 | 3/1976 | Bradbury et al. | 241/40 X |
| 4,244,528 | 1/1981 | Vlnaty | 241/40 X |
| 4,354,641 | 10/1982 | Smith | 241/40 |

*Primary Examiner*—Howard N. Goldberg
*Assistant Examiner*—Timothy V. Eley
*Attorney, Agent, or Firm*—Arthur A. Jacobs

[57] ABSTRACT

A jet-type grinding system for grinding relatively large particles, such as coal and the like, wherein the particles to be ground are entrained in a circulating gaseous vortex in which the particles are caused to pulverize each other, the system including a mill having a grinding chamber succeeded by a classifier section in which smaller ground particles are initially separated from larger ground particles, this classifier section constituting a primary separator, the primary separator being in operative connection with a secondary separator into which ground particles pass from the first separator for additional classification and separation into smaller and larger particles, and a tertiary separator inoperative connection wtih the secondary separator to provide passage from the secondary to the tertiary separator of ground particles for additional classification and separation of smaller from larger particles, the passage of all of the particles from one separator to the other being by centrifugal force, and the secondary separator having a shelf in the centrifugal path of the larger particles to aid in separation of such particles from the smaller particles.

7 Claims, 4 Drawing Figures

FIG. 2
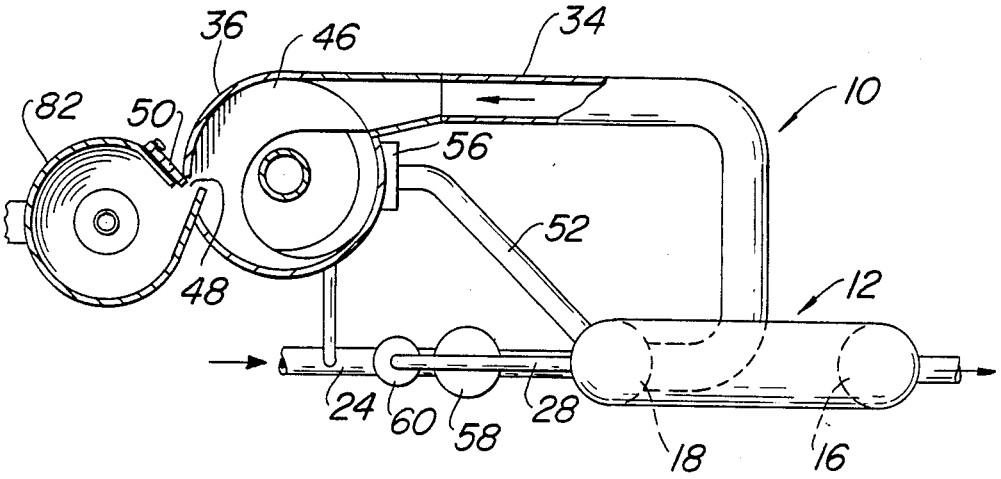
FIG. 3
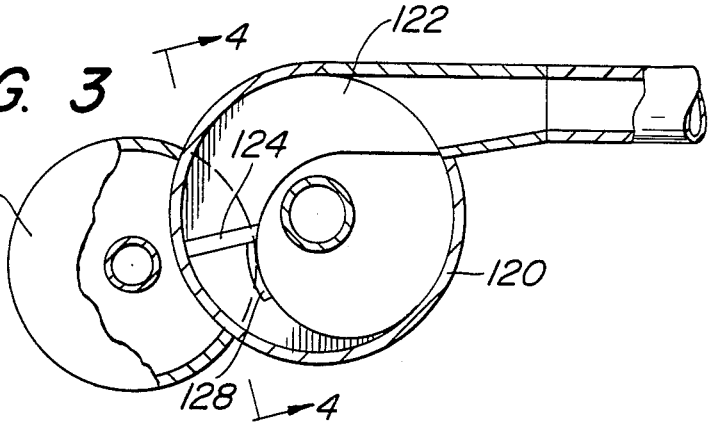
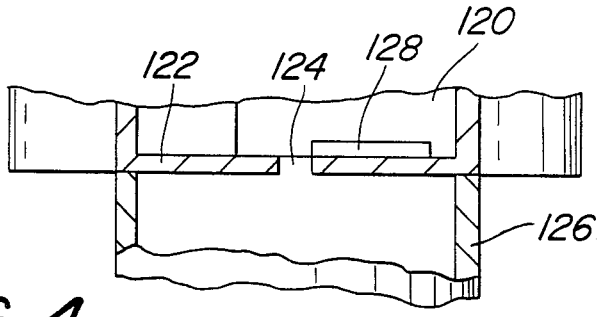
FIG. 4

JET-TYPE GRINDING SYSTEMS FOR LARGE PARTICLES

This invention relates to jet-type grinding mills and mill systems utilizing whirling gaseous fluids as the grinding or pulverizing medium, and it particularly relates to mills and mill systems of this type that are particularly adapted to grind or pulverize particles of relatively large size such as coal or the like.

Grinding mills of the aforesaid jet-type have, theretofore, generally been used for the treatment of relatively small particles. Although some attempts were made to utilize such jet mills for coarser particles such as coal, they were never completely satisfactory because it was not possible to obtain a product having a sufficient degree of fineness to permit its use in place of oil or gas. This was due to the difficulty of separating out not only the larger particles of coal but also such impurities as ash, pyrites, aluminum oxide, silica, and the like. It is highly important to eliminate pyrites, not only because of these particles but because the major portion of the sulfur content in the raw coal is generally bound in the pyrites particles. It is also desirable to eliminate the ash, which includes clays, kaolin, silica, etc., not only because it interferes with the combustion of the coal but also because it tends to deposit on the boiler tubes and causes slagging.

It is, therefore, an object of the present invention to provide a jet-type grinding mill system and a process of utilizing it which is capable of providing ultrafine particles of combustible material, such as coal and the like, substantially free of undesirable impurities.

Another object of the present invention is to provide a jet-type grinding mill system which can utilize the standard type jet mill without substantial modification thereof while yet obtaining the aforesaid ultrafine particles substantially free of undesirable impurities.

FIG. 2 is a sectional view taken on line 2—2 of FIG. 1.

FIG. 3 is an enlarged sectional view of a modified form of the secondary classifier means.

FIG. 4 is a sectional view taken on line 4—4 of FIG. 3.

Figure 1:
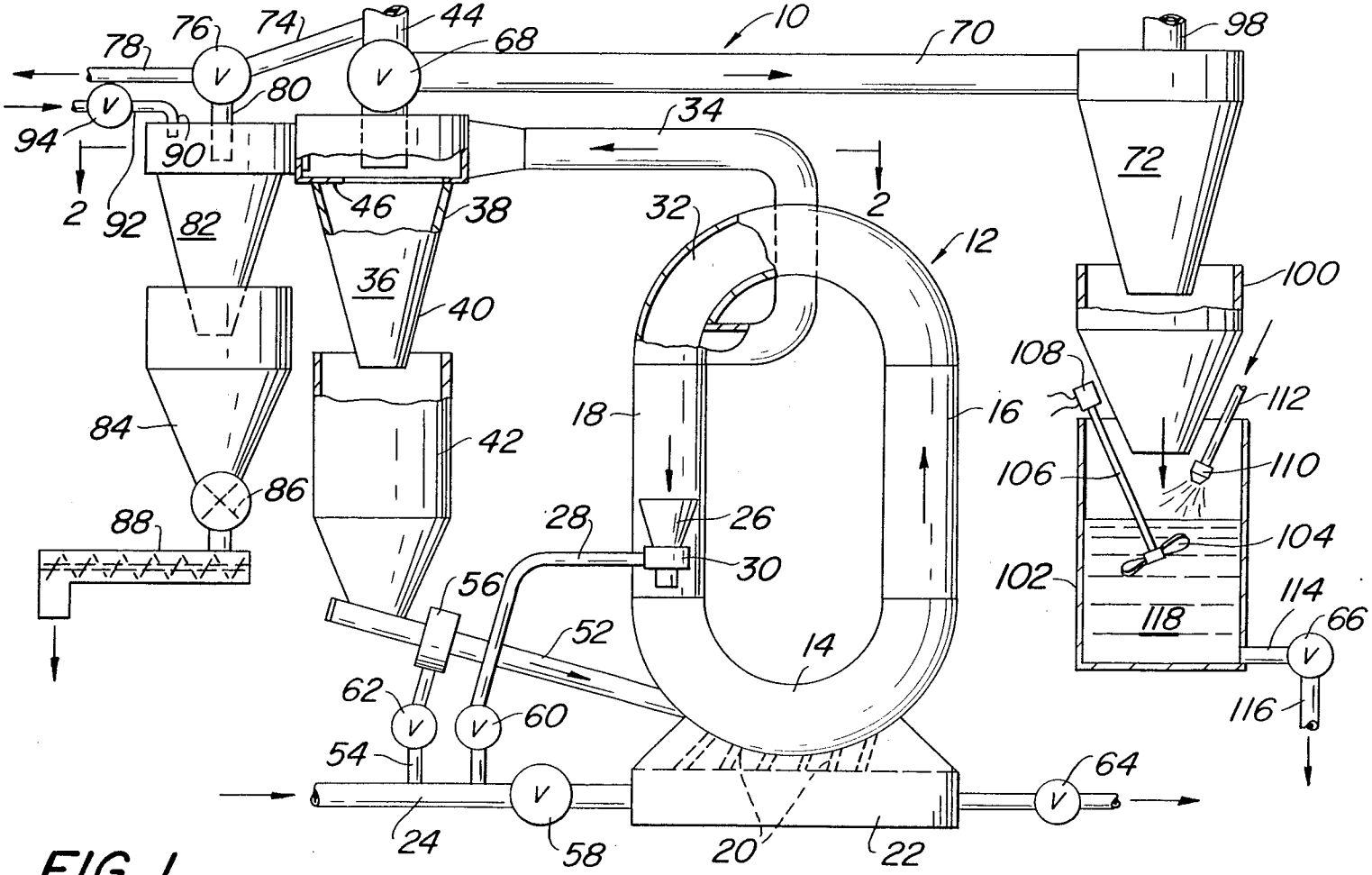
FIG. 1 is a side view, partly in elevation and partly in section, of a jet mill grinding system embodying the present invention.

Referring in greater detail to the drawings wherein similar reference characters refer to similar parts, there is shown in FIG. 1 a mill system generally designated 10, comprising a jet mill 12 that includes a lower inlet or grinding chamber 14, an upstack 16 and a downstack 18. Angular or tangential inlet nozzles 20 lead into the bottom of inlet chamber 14 from a manifold 22 which receives gaseous fluid, such as air, steam or the like, through a conduit 24 from a source (not shown). The gas is introduced into the manifold and is converted by the nozzles 20 into acoustic or super acoustic low pressure jets which, as they pass into the grinding chamber, generate high velocity flow in the mill. The material to be ground is inserted into the grinding chamber through the hopper 26 and is accelerated in its passage by gaseous fluid under pressure from a conduit 28 leading into a collar 30 surrounding the downspout of the hopper, the collar having apertures leading into the hopper.

The particles being treated are pulverized or ground by mutual impact as they are entrained in the upflowing gaseous vortex in the grinding chamber and, as they pass by centrifugal force from the upstack 16 into the arcuate classifier section 32 at the upper portion of the mill, there is centrifugal stratification of the particles whereby the heavier coarser particles remain on the outer periphery while the lighter, finer particles are whirled toward the center or inner periphery. As the particles pass down toward the downstack, the lighter particles at the inner periphery pass into the outlet duct 34 while the heavier particles at the outer periphery pass down to mix with newly inserted material from the hopper 26 and then into the grinding chamber 14 for further pulverization.

In order to make the process more economically feasible, a very high mill throughput, using high loads, is required. With such high loads, the coarser or heavier fraction stream at the outer periphery widens and the product leaving the mill through conduit 34 has more of the heavier particles than when lower loads are used. Since much of these heavier particles usually comprise such undesirable impurities as ash, pyrites, aluminum oxide, silica, and the like, the product leaving the mill would, at this point, be generally unsatisfactory.

The product is made more satisfactory by the use of a secondary classifier or separator 36 having an upper portion 38 and a lower portion 40. The secondary classifier 36 is a relatively low velocity centrifugal separator wherein the recirculating flow is much less vigorous than the flow in the primary separator formed by the classifier section 32 of the mill 12. In the separator 36 the heavier coarser particles hug the outer wall of the separator and fall into the receiver 42 below the separator while the finer lighter particles spiral inwardly and pass upwardly through the outlet tube 44.

The upper portion 38 of the separator 36 is wider than the lower portion 40 and a spiral shelf 46 separates the upper portion 38 from the lower portion 40. This shelf (best shown in FIG. 2) extends horizontally from the inlet of the conduit, where the shelf is widest, to a point about 135° from the inlet, where it is narrowest.

The shelf 46 acts as initial separator of the heaviest particles which pass from conduit 34. These heaviest particles are on the outer periphery as they pass into the upper portion 38 and are caught by the shelf along which they whirl until the most heavy of them, passing on the outermost periphery of the shelf, pass out through the slot 48. The size of this slot is adjustable by the slidably adjustable plate 40. The less heavy particles, on the inner periphery of the shelf, pass down into a conduit 52 through which they travel back into the grinding chamber 14 of the mill 12 for further grinding in admixture with the new material entering the mill from hopper 26. The passage of the particles through the conduit 52 is accelerated by gaseous fluid under pressure passing through conduit 54 into a collar 56 having tangential nozzles for passing the gaseous fluid downwardly through the conduit 52.

The various fluid conduits have adjustable shut-off valves, as shown at 58, 60, and 62 in the respective conduits heretofore described, and at 64 and 66 in the conduits yet to be described. A multiple-position diverting value 68 is provided in stack 44 and leading from this valve is a conduit 70 extending into a centrifugal separator 72 serving as a tertiary separator. Above the valve 68 a conduit 74 leads from the stack 44 to a three-way diverting valve 76. An exhaust tube 78 leads from one side of valve 76 to a collection or distribution station (not shown). A stack 80 connects valve 76 with the top of a relatively quiescent centrifugal separator 82 which is of smaller diameter than the separator 36.

If it is desired to pass the fine particles from the separator 82 through the stack 44 to another treating or distribution area, the valve 68 is adjusted to open the connection between conduit 74 and stack 44 and the valve 76 is adjusted to connect conduit 74 with conduit 78. If it is desired to mix the exhaust particles from the separator 82 with that from separator 36, both valves 68 and 76 are opened so that they flow upwardly through the stack 44 mixed with flow from the conduit 78. If it is desired to direct the exhaust particles from separator 36, either by themselves or in admixture with the exhaust particles from separator 82, into separator 72, the valve 68 is adjusted to connect stack 44 to conduit 70 and the valve 76 is either opened or closed, depending on whether the particles from separator 82 are to be intermixed with those from separator 36. In the alternative, the valve 68 may be adjusted to establish communication only between separator 82 and separator 72.

The separator 82 leads into the receiver 84 into which the heavier particles pass from the separator 82. A gate 86 at the bottom of receiver 84 permits the particles to drop onto a conveyor for 88 removal. These last particles are primarily the ash, pyrites, and other impurities, and are removed from the system.

Leading into the top of separator 82 is a nozzle 90, connected to a source of gaseous fluid under pressure by a conduit 92. An adjustable shut-off valve 94 is provided in the conduit 92. The pressure fluid in conduit 92 may be adjusted or entirely shut off by the valve 94. In the event an undue amount of the desirably fine particles escape through the slot 48, the pressurized fluid from nozzle 90 acts as a dynamic barrier to prevent egress of these fine particles through the slot. The pressure may even be increased to the point where it can cause back-flow of the lighter particles into the separator 36. However, the pressure of the fluid is never increased sufficiently to act as a barrier against the larger particles, which pass through the slot with greater force, and these larger particles, therefore, do pass through the slot into separator 82.

The separator 72, to which the exhausted finer particles are directed from stack 44 when the valve 68 is adjusted to open into conduit 70, is a relatively quiescent centrifugal type.

The particles directed into separator 72 are for the purpose of being mixed with oil to form a coal/oil mixture which may either be briquetted, stored as a fluid mixture or passed directly to a burner for combustion.

The very lightest particles are passed from the separator 72 through an upstack 98 to an exhaust and these exhausted light particles may be used for any desired purpose. The heavier, but still high particles received from conduit 70 are passed down into a quiescent receiver 100 from which they fall into a mixing chamber 102. The chamber 102 is provided with a paddle 104 on a shaft 106 operated by an electric motor 108. A spray nozzle 110 is connected by a conduit 112 to a source of oil (not shown). An outlet conduit 114 is connected by the previously mentioned valve 66 to an outlet spout 116.

In operation, the particles from receiver 100 are mixed in the chamber 102 with a spray of oil from the nozzle 110 and the resultant liquified product 118 is removed through outlet 114 and spout 116.

FIGS. 3 and 4 illustrate a modified form of the invention wherein instead of the tertiary separator being in the same plane as the secondary separator, as in the case of separators 82 and 36, the tertiary separator is below the secondary separator with the upper portions of the two separators partially overlapping.

This modified construction is shown in FIGS. 3 and 4 by secondary separator 120 which is, in general, identical to separator 36 except that the shelf 122 is provided with a slot 124. A tertiary separator 126 is generally identical to separator 82 but is positioned below the separator 120 so that the wide upper end thereof partially underlies the wider upper end of separator 120.

With the construction shown in FIGS. 3 and 4, the heavier particles on the entire shelf of the secondary separator, not only on its outer periphery, are passed into the tertiary separator, which is sometimes desirable since all the particles on the shelf are heavy, although of varying sizes and weights. The drop-off, furthermore, is not dependent only on centrifugal force but also on gravity.

An elevated barrier wall 128 is optionally provided for a certain distance beyond the slot 124 to help restrain any particles remaining on the shelf from fall down into the separator 120 until they reach the end of the shelf.

If desired, both horizontal and vertical slots, as shown at both 48 and 124, may be used together.

The invention claimed is:

1. A jet-type grinding system for grinding relatively large particles comprising a generally arcuate mill having a grinding chamber wherein particles are subjected to mutual pulverization in a vortex of gaseous fluid, a classification section forming a primary separator where smaller ground particles are centrifugally separated from larger ground particles, the smaller particles being stratified in an inner peripheral area and the larger particles in an outer peripheral area of a circulating stream of particles and gaseous fluid, and a downstack leading from said classification section back to said grinding chamber for further pulverization of said larger particles, a small particle outlet being in communication with a secondary separator where additional centrifugal stratification and separator of small from less small particles occurs, the small particles being in an inner peripheral portion and the less small particles being in an outer peripheral portion of a circulating stream of gaseous fluid and particles, a small particle outlet extending from the area in said secondary separator corresponding to the center of circulation of said circulating stream, a shelf in said secondary separator underlying the area corresponding to said outer peripheral portion of said circulating stream, and a tertiary centrifugal separator in communication with said secondary separator through a large particle outlet in said secondary separator, said larger particle outlet being in the path of said circulating stream to provide egress of particles in the outer peripheral portion of said stream into said tertiary separator.

2. The system of claim 1 wherein an upstanding barrier wall is provided on said shelf adjacent said slot.

3. A jet-type grinding system for grinding relatively large particles comprising a generally arcuate mill having a grinding chamber wherein particles are subjected to mutual pulverization in a vortex of gaseous fluid, a classification section forming a primary separator where smaller ground particles are centrifugally separated from larger ground particles, the smaller particles being stratified in an inner peripheral area and the larger particles in an outer peripheral area of a circulating arcuate stream of particles and gaseous fluid, and a downstack leading from said classification section back to said grinding chamber for further pulverization of said larger particles, a small particle outlet being in communication with an inlet of a secondary separator where additional centrifugal stratification and separation of small from less small particles occurs, the small particles being in an inner peripheral portion and the less small particles being in an outer peripheral portion of a circulating stream of gaseous fluid and particles in said secondary separator, a small particle outlet extending from the area in said secondary separator corresponding to the center of circulation of said circulating stream, a shelf in said secondary separator generally parallel to and underlying the area corresponding to said outer peripheral portion of said circulating stream, said shelf extending from said inlet in a horizontal plane to a position remote from said inlet, said shelf being relatively wide adjacent said inlet and relatively narrow at said position arcuately remote from said inlet, and a tertiary centrifugal separator in communication with said secondary separator through a large particle outlet in said secondary separator, said large particle outlet being in the path of said circulating stream to provide egress of particles in the outer peripheral portion of said stream into said tertiary separator.

4. The system of claim 1 wherein said large particle outlet is positioned in the outer wall of the secondary separator above but adjacent to said shelf.

5. The system of claim 4 wherein means are provided to adjust the size of said large particle outlet.

6. The system of claim 3 wherein said secondary and tertiary separators are in selective communication with means for intermixing particles exhausted from said separators with a liquid fuel.

7. The system of claim 6 wherein the liquid fuel is oil.

* * * * *